US008186510B1

(12) United States Patent
Chen

(10) Patent No.: US 8,186,510 B1
(45) Date of Patent: May 29, 2012

(54) SCREWDRIVER KIT

(76) Inventor: Ming-Nan Chen, Taichung (TW)

( * ) Notice: Subject to any disclaimer, the term of this patent is extended or adjusted under 35 U.S.C. 154(b) by 0 days.

(21) Appl. No.: 12/929,545

(22) Filed: Feb. 1, 2011

(51) Int. Cl.
*B65D 85/28* (2006.01)

(52) U.S. Cl. ..... 206/375; 206/373; 206/377; 206/751

(58) Field of Classification Search ..... 206/751, 206/754, 373, 374, 375, 376, 377, 378, 379; 211/70.6
See application file for complete search history.

(56) References Cited

U.S. PATENT DOCUMENTS

| | | | | |
|---|---|---|---|---|
| 5,570,784 | A * | 11/1996 | Sidabras et al. | 206/378 |
| 5,826,719 | A * | 10/1998 | Chen | 206/373 |
| 6,070,732 | A * | 6/2000 | Chen | 206/751 |
| 7,032,750 | B2 * | 4/2006 | Amtenbrink | 206/379 |
| 7,077,267 | B2 * | 7/2006 | Lee | 206/373 |
| 7,168,559 | B2 * | 1/2007 | Chen | 206/373 |
| 7,530,459 | B2 * | 5/2009 | Yeh | 206/372 |
| 8,016,108 | B1 * | 9/2011 | Hung | 206/379 |
| 2003/0205493 | A1 * | 11/2003 | Chen et al. | 206/378 |
| 2010/0032327 | A1 * | 2/2010 | Lai | 206/375 |

* cited by examiner

*Primary Examiner* — David Fidei
(74) *Attorney, Agent, or Firm* — Bacon & Thomas, PLLC

(57) ABSTRACT

A screwdriver kit includes a recessed base comprising a divider wall for dividing an internal space into first and second compartments, the divider wall including an opening; a spring biased cover hingedly secured to the base and having a latch; two spring biased receiving structures in the first compartment, each receiving structure comprising screwdriver head receiving slots; a spring biased pivotal structure in the second compartment and comprising a top slope and a lock pin inserting through the opening into the first compartment to be locked by the latch; and a spring biased push button on the pivotal structure and comprising a bottom protrusion engaged with the slope. In response to pressing the push button the projection slides downward along the slope to pivot the pivotal structure and disengage the lock pin from the latch, thereby unlocking the cover and upward pivoting the receiving structures.

12 Claims, 8 Drawing Sheets

SCREWDRIVER KIT

BACKGROUND OF THE INVENTION

1. Field of Invention

The invention relates to tool holders and more particularly to a flat card-like screwdriver kit with handle and heads removal facilitation arrangement so that an individual may easily choose a desired one of heads to assemble with the handle as a complete screwdriver.

2. Description of Related Art

Head (or tip) of a screwdriver may be a flat tip, a Robertson tip, a Phillips tip, or one of others. Typically, the head is an integral part of an axial shaft of the screwdriver. Thus, it is often that an individual, especially an employee of some trades, may prepare many screwdrivers having different heads. This, however, not only bears a great financial burden but also occupies a great space for storing them when not in use. Moreover, such different screwdrivers are not inconvenient to carry to a work place.

Nowadays, there is a type of screwdriver having a handle with detachable head (i.e., the part of the screwdriver which engages with the screw) commercially available. It allows a set of one handle and several heads to be used for a variety of screw sizes and types. The handle and the accompanying heads are typically stored in a kit and together are sold as a unit. A person may assemble the handle with a desired one of heads prior to use. Such screwdrivers have the advantages of saving cost and saving storage space.

One type of above screwdriver kit has the heads arranged vertically with respect to its bottom. It allows a person to pick a desired head from above. However, the kit has a relatively high elevation (i.e., not being flat). Further, it is inconvenient to carry and somewhat bulky.

The other type of above screwdriver kit has the heads arranged horizontally on the bottom. However, a person has to laterally pull a desired head and remove same prior to assembling with the handle. However, this assembly is somewhat complicated and inconvenient. Moreover, it is difficult of inserting fingers into the kit for head removal since space within the kit is crowded with the heads.

Thus, there is a need for a flat card-like screwdriver kit with handle and heads removal facilitation arrangement.

SUMMARY OF THE INVENTION

It is therefore one object of the invention to provide a screwdriver kit comprising a rectangular, recessed base comprising a divider wall for dividing a space defined by the base into a first, compartment and a second compartment, the divider wall including an opening; a cover comprising first spring means hingedly secured to the base so as to either close the base in a closed position with the first spring means being compressed or open the base in an open position, and a latch distal the first spring means; two receiving structures disposed in the first compartment, each receiving structure comprising a plurality of slots facing the other receiving structure for receiving a plurality of screwdriver heads, and second spring means for pivotably securing the receiving structure to the base so that the receiving structure can be disposed in either a first position substantially parallel to the bottom of the base when the base is in the closed position or a second position at a predetermined angle with respect to the bottom of the base when the base is in the open position; a pivotal structure disposed in the second compartment and comprising a main body including a top slope and a lock pin inserting through the opening into the first compartment to be locked by the latch, and third spring means biased between the main body and the base so as to move the lock pin relative to the opening in response to moving the main body; and a push button disposed on the pivotal structure and comprising a body member including a bottom protrusion engaged with the slope, and fourth spring means biased between the body member and the main body; wherein in response to pressing the body member the fourth spring means is compressed and the projection slides downward along the slope to pivot the pivotal structure and disengage the lock pin from the latch, thereby unlocking the cover; wherein the first spring means releases its stored elastic energy to pivotably open the cover and unlock the receiving structures; and wherein the second spring means releases its stored elastic force to pivot each receiving structure upward until reaching the predetermined angle.

The above and other objects, features and advantages of the invention will become apparent from the following detailed description taken with the accompanying drawings.

DETAILED DESCRIPTION OF THE INVENTION

Figure 1:
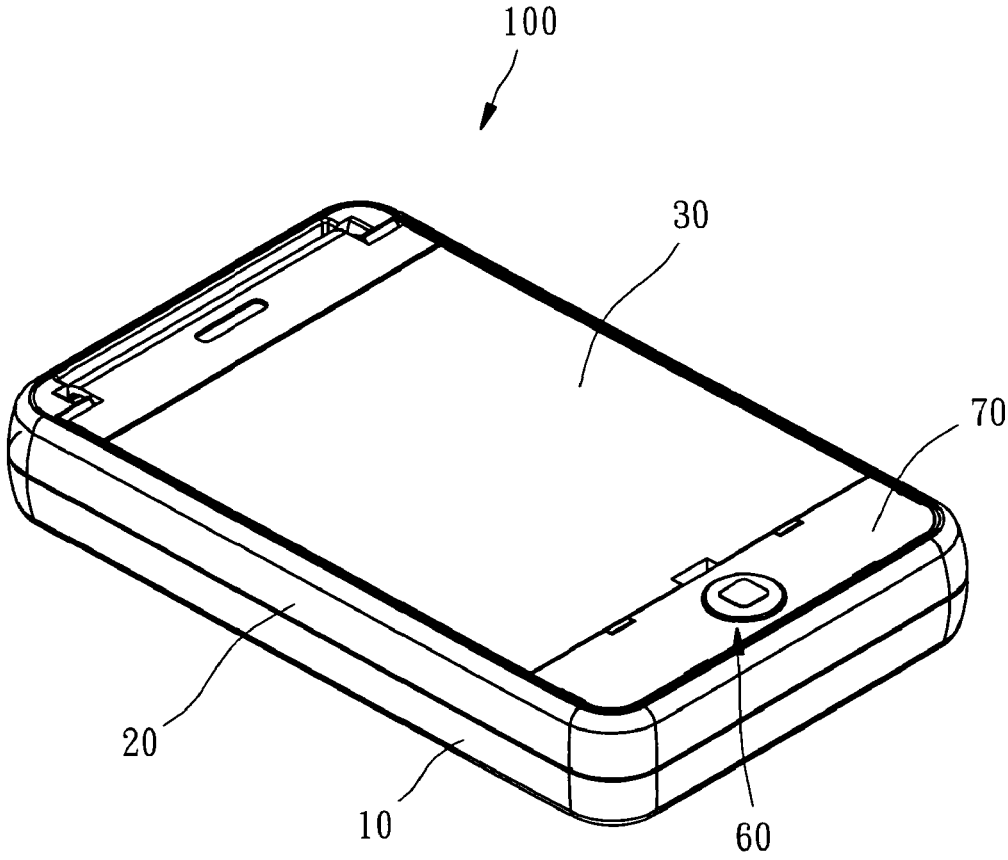
FIG. 1 is a perspective view of a screwdriver kit according to the invention.
Figure 2:
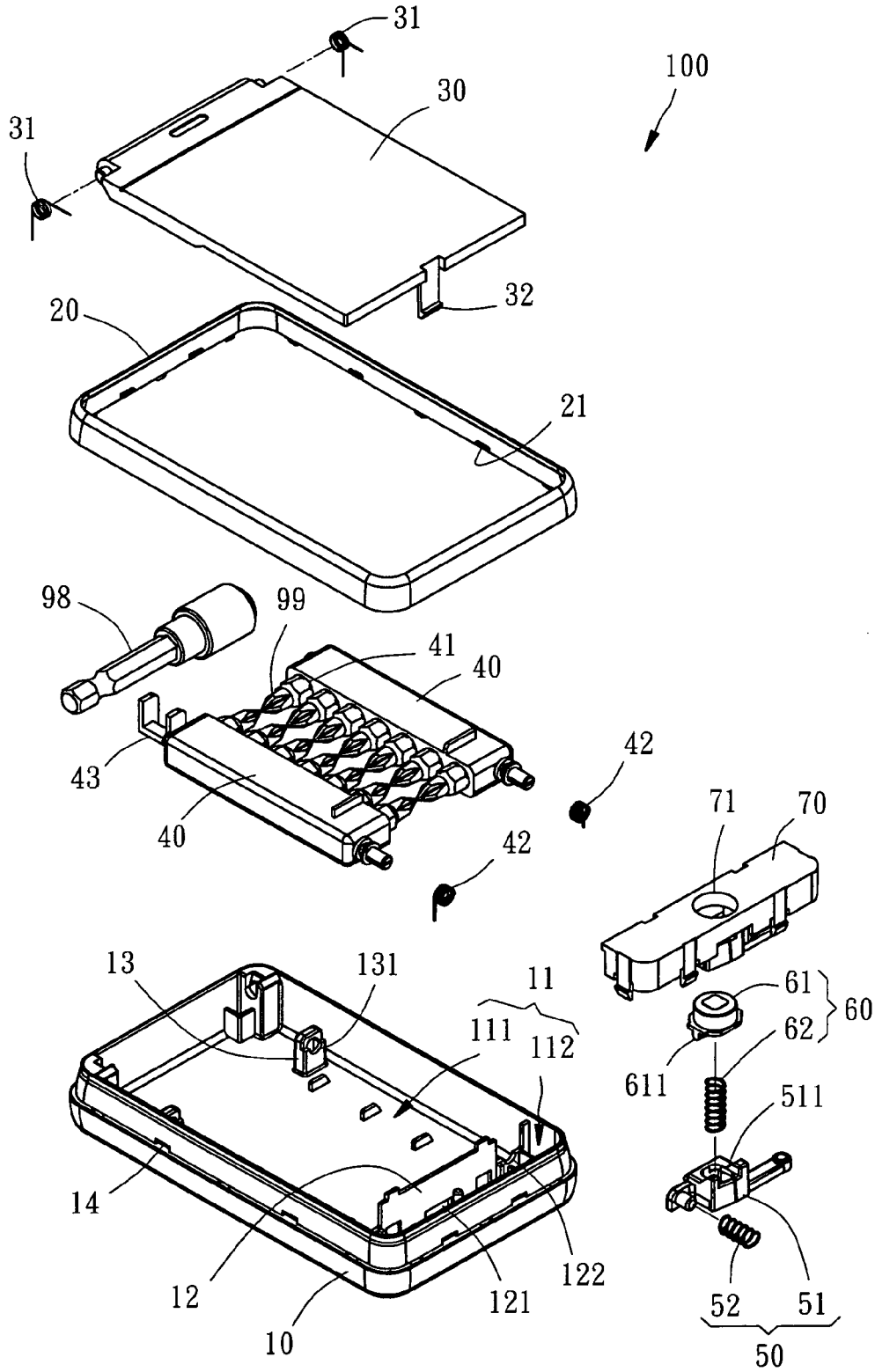
FIG. 2 is an exploded view of the screwdriver kit showing the handle, the heads, and other components.
Figure 3:
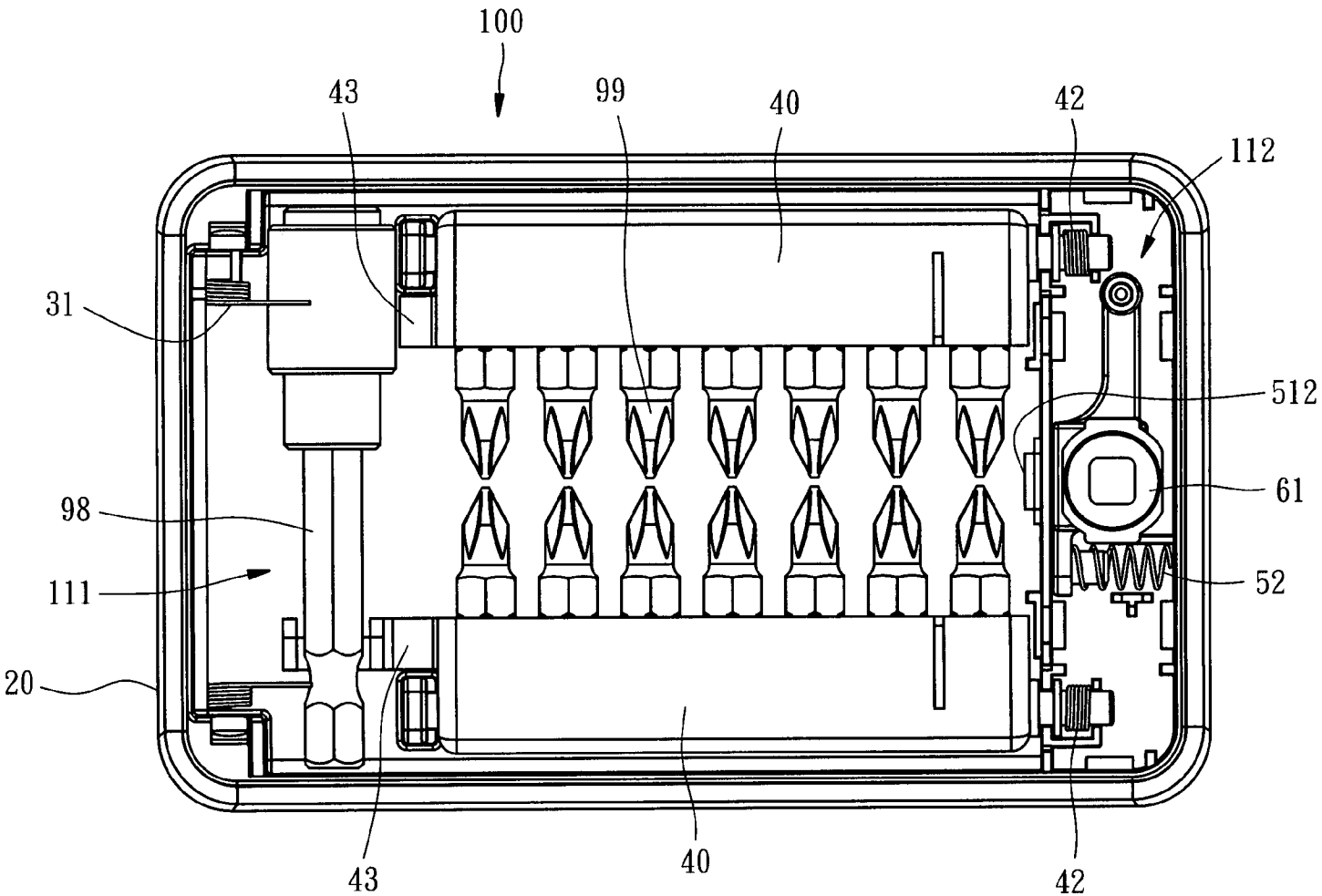
FIG. 3 is a top plan view of the screwdriver kit with the cover removed.
Figure 4:
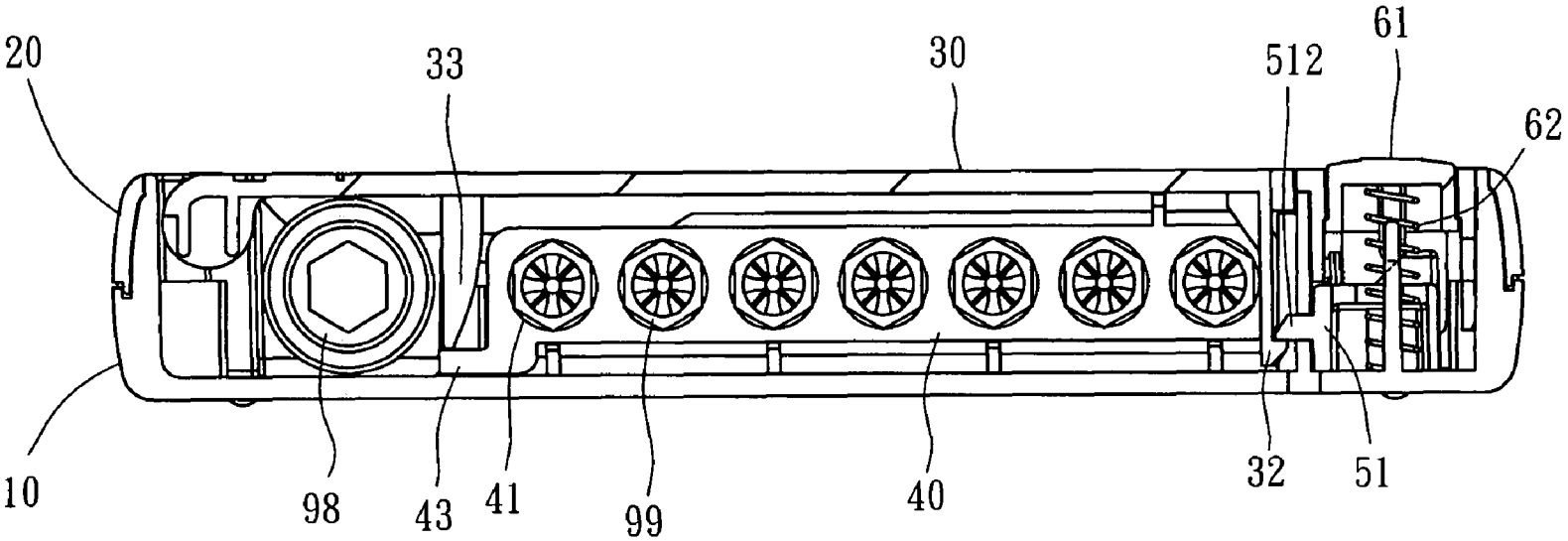
FIG. 4 is a longitudinal sectional view of the screwdriver kit of FIG. 1.

Referring to FIGS. 1 to 10, a screwdriver kit 100 in accordance with the invention comprises a base 10, a rectangular peripheral frame 20, a cover 30, two opposite receiving structures 40, a pivotal structure 50, a push button 60, and a limit block 70 each discussed in detail below.

The base 10 is rectangular and recessed to have a height. The base 10 has a closed flange upward projecting from the edges together with the bottom to define a space 11. A divider wall 12 is provided on the bottom proximate to one end for dividing the space 11 into a first compartment 111 and a second compartment 112 which is much smaller than the first compartment 111. Two opposite pivot seats 13 are provided proximate to both sides of the base 10. The pivot seat 13 has a pivot hole 131. The divider wall 12 has an intermediate opening 121 and two concave portions 122 proximate to both ends respectively. A plurality of engaging slots 14 are provided on the outer surface of the peripheral edge of the base 10.

A plurality of wedges 21 are provided on the inner surface of the frame 20. The wedges 21 are inserted into the engaging slots 14 for securing the frame 20 and the base 10 together.

The cover 30 is rectangular and has two torsion springs 31 put on both projecting axial ends of one end respectively. The cover 30 is hingedly secured to the base 10 by means of the springs 31. Thus, the cover 30 can be disposed in a closed position (see FIG. 4) or an open position (see FIG. 5) by pivoting about the hinge. The opening of the cover 30 is made possible by releasing stored elastic force of the springs 31. A downward extending latch 32 is formed at the other end of the cover 30 opposing the hinge. Also, two projections 33 are formed on the bottom of the cover 30 proximate to the hinge.

Each receiving structure 40 is substantially a parallelepiped and comprises a plurality of slots 41 on one surface facing the other receiving structure 40. Different screwdriver heads 99 can be partially fitted in the slots 41 for storage. One end of the receiving structure 40 is pivotably inserted into the pivot hole 131 and the other projecting end thereof is rotatably disposed on the concave portion 122. Two torsion springs 42 each is put on the other projecting end of the receiving structure 40 and pivotably fastens the receiving structure 40 at the concave portion 122 by anchoring at the inner surface of the base 10. This means that the receiving structures 40 can be placed horizontally or pivoted an angle with respect to the bottom of the base 10. This also means that the pivoted receiving structures 40 can be returned to its horizontal position when the elastic force of the springs 42 is released. A U-shaped member 43 is provided at one end of the receiving structure 40 for supporting a screwdriver handle 98.

The pivotal structure 50 comprises a main body 51 disposed in the second compartment 112 and a compression spring 52 put on a projection (not numbered) of the main body 51 and biased between the main body 51 and the inner surface of the base 10 so that the main body 51 (i.e., the pivotal structure 50) may pivotably move as the spring 52 compresses or expands. A slope 511 is formed on top of the main body 51. A lock pin 512 is provided on one surface of the main body 51 opposite the other surface of the main body 51 with the spring 52 anchored thereon. The lock pin 512 inserts through the opening 121 into the first compartment 111.

The push button 60 comprises a cylindrical body member 61 having a bottom protrusion 611 engaged with the slope 511, and a helical spring 62 biased between the body member 61 and the main body 51. Thus a pressing of the body member 61 may compress the spring 62 to cause the protrusion 611 to slide downward along the slope 511.

The limit block 70 is substantially a parallelepiped and disposed in the second compartment 112. The limit block 70 comprises an intermediate through hole 71 with the body member 61 of the push button 60 being slidably disposed therein. The limit block 70 is provided on the top of the pivotal structure 50.

Operations of the screwdriver kit 100 will be described in detail below. In a closed position of the kit 100, the latch 32 is locked by the lock pin 512 (see FIGS. 4 and 7) and the first compartment 111 is closed by the cover 30 (see FIGS. 2 and 4). Also, the projections 33 urge against the U-shaped members 43 (see FIGS. 4 and 8). Thus, the receiving structures 40 are disposed in a horizontal position (i.e., the handle 98 and the heads 99 are laid horizontally). This renders the kit 100 to be a flat card-like member for saving the storage space.

Figure 9:
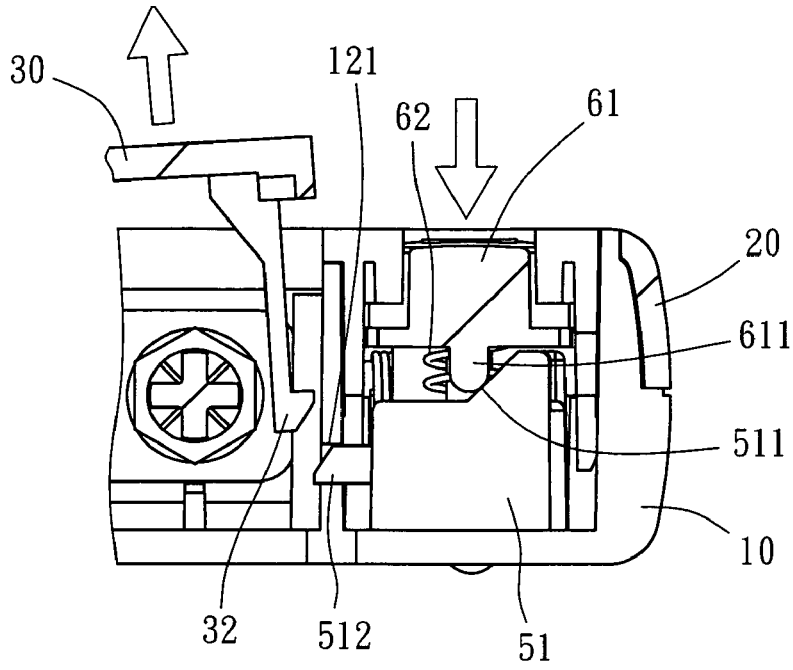
FIG. 9 is a view similar to FIG. 7 showing the push button being pressed to pivotably open the cover.

As shown in FIG. 9, for using a screwdriver a person may press the body member 61 of the push button 60 with a finger so as to compress the spring 62 and move the projection 611 downward. And in turn, the protrusion 611 slides downward along the slope 511. As such, the main body 51 of the pivotal structure 50 moves rightward to move the lock pin 512 rightward too. Thus, the lock pin 512 is disengaged from the latch 32. Note that the movement of the lock pin 512 is confined by the opening 121 (i.e., not allowed to clear the opening 121). Also, the cover 30 is unlocked.

Figure 5:
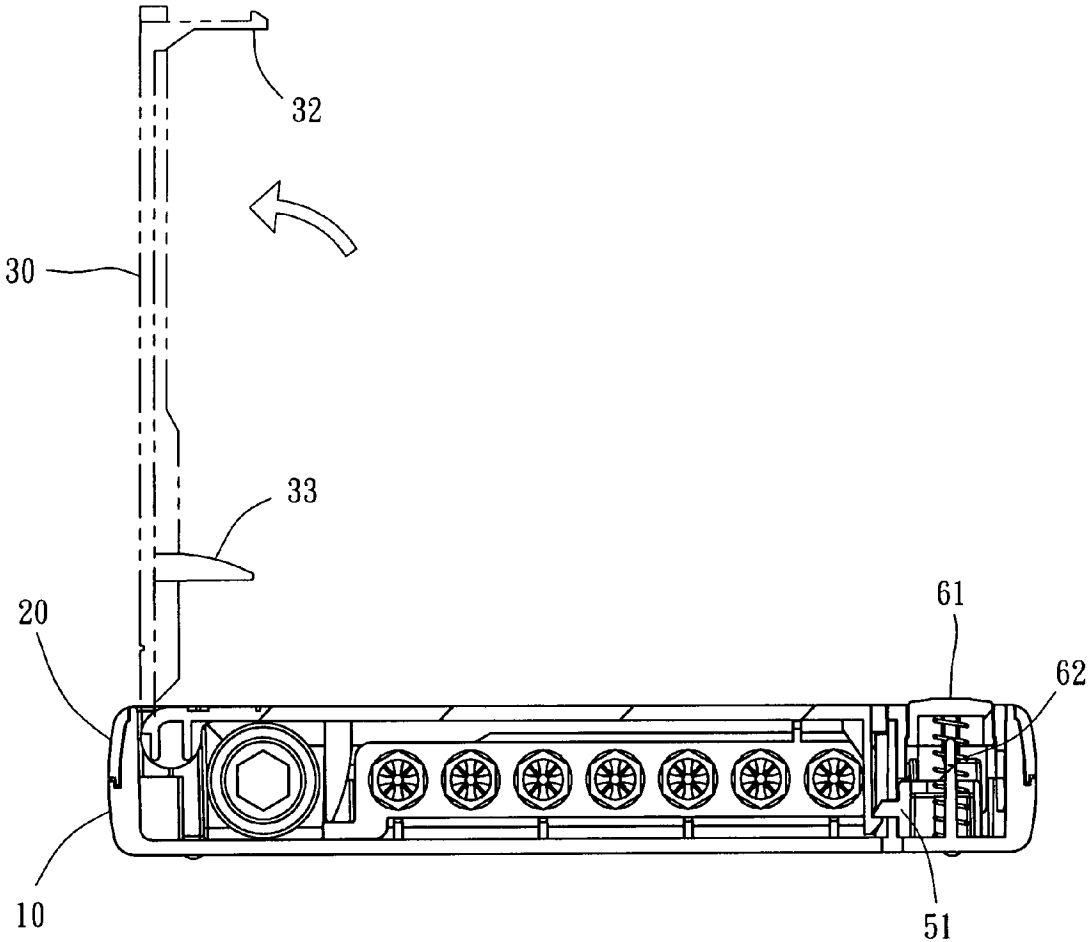
FIG. 5 is a view similar to FIG. 4 with the cover being pivoted to an upright position.
Figure 6:
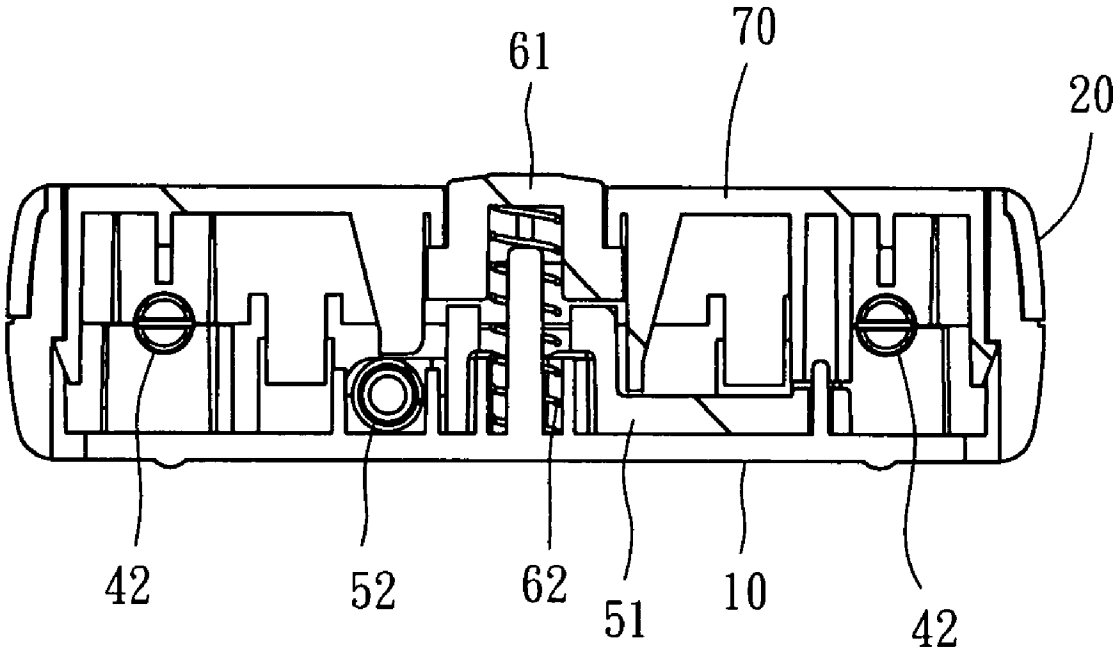
FIG. 6 is another longitudinal sectional view of the screwdriver kit of FIG. 1.
Figure 7:
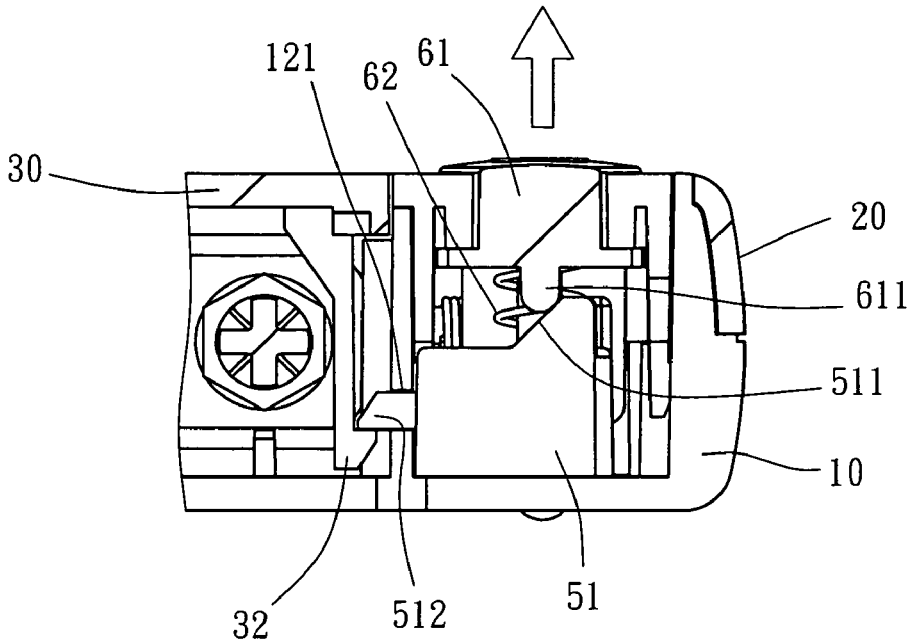
FIG. 7 is a fragmentary view of the right side portion of the screwdriver kit of FIG. 1 showing the push button to be moved upward.
Figure 8:
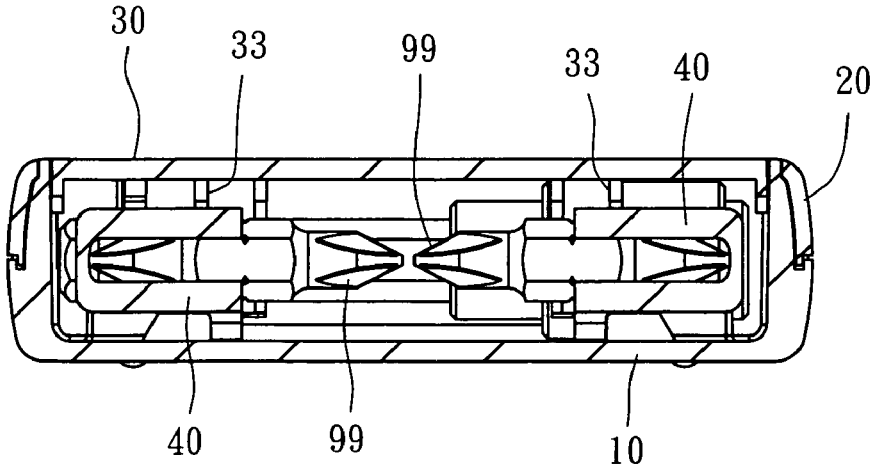
FIG. 8 is still another longitudinal sectional view of the screwdriver kit of FIG. 1.

As shown in FIG. 5, the energized cover 30 (due to the stored elastic energy of the springs 31) thus opens to disengage the projections 33 from the U-shaped members 43. The cover 30 may dispose in a vertical position at the end of the pivotal movement.

Figure 10:
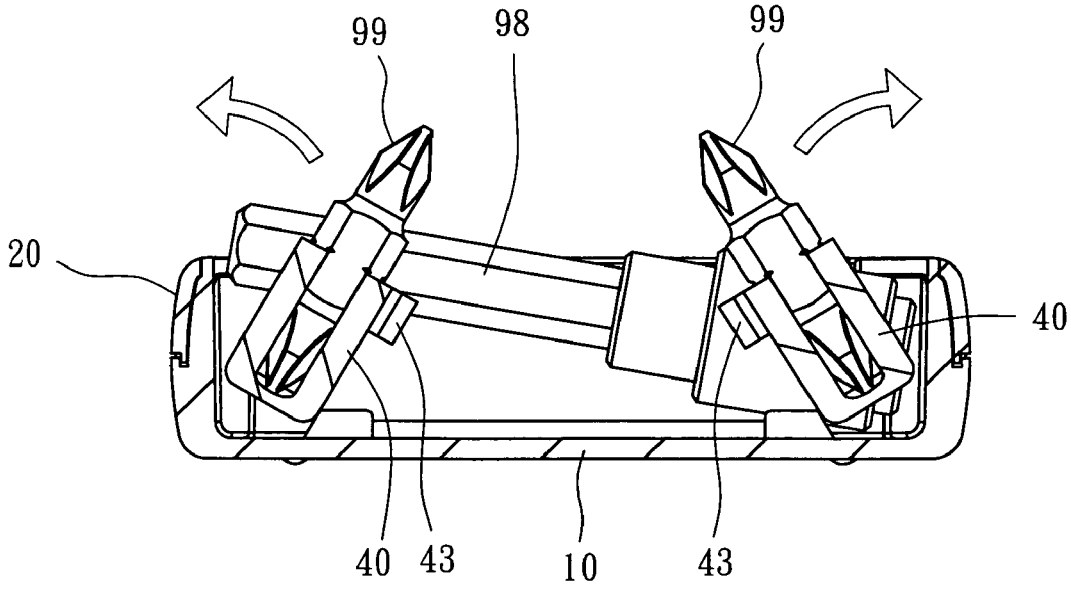
FIG. 10 is a view similar to FIG. 8 showing the opposite heads being pivoted to be ready for use as a result of the opening of the cover.

As shown in FIG. 10, the receiving structures 40 is not stopped by the cover 30 and the stored elastic force of the springs 42 is released to pivot the receiving structures 40 upward. The receiving structures 40 may dispose in a vertical position at the end of the pivotal movement. Thus, the handle 98 and the heads 99 are faced upward. This facilitates the person to remove the handle 98 and a desired one of the heads 99 and assemble same as a complete screwdriver. This is very convenient. Moreover, the space 11 is fully utilized.

While the invention has been described in terms of preferred embodiments, those skilled in the art will recognize that the invention can be practiced with modifications within the spirit and scope of the appended claims.

What is claimed is:

1. A screwdriver kit comprising:

a rectangular, recessed base comprising a divider wall for dividing a space defined by the base into a first compartment and a second compartment, the divider wall including an opening;

a cover comprising first spring means hingedly secured to the base so as to either close the base in a closed position with the first spring means being compressed or open the base in an open position, and a latch distal the first spring means;

two receiving structures disposed in the first compartment, each receiving structure comprising a plurality of slots facing the other receiving structure for receiving a plurality of screwdriver heads, and second spring means for pivotably securing the receiving structure to the base so that the receiving structure can be disposed in either (i) a first position substantially parallel to the bottom of the base when the base is in the closed position or (ii) a second position at a predetermined angle with respect to the bottom of the base when the base is in the open position;

a pivotal structure disposed in the second compartment and comprising a main body including a top slope and a lock pin inserting through the opening into the first compartment to be locked by the latch, and third spring means biased between the main body and the base so as to move the lock pin relative to the opening in response to moving the main body; and a push button disposed on the pivotal structure and comprising a body member including a bottom protrusion engaged with the slope, and fourth spring means biased between the body member and the main body;

wherein in response to pressing the body member the fourth spring means is compressed and the projection slides downward along the slope to pivot the pivotal structure and disengage the lock pin from the latch, thereby unlocking the cover;

wherein the first spring means releases its stored elastic energy to pivotably open the cover and unlock the receiving structures; and wherein the second spring means releases its stored elastic force to pivot each receiving structure upward until reaching the predetermined angle.

2. The screwdriver kit of claim 1, wherein the base has a predetermined height, and wherein the second compartment is smaller than the first compartment.

3. The screwdriver kit of claim 1, further comprising two opposite pivot seats on the first compartment, each pivot seat comprising a pivot hole, wherein the divider wall further comprises two concave portions proximate to both ends respectively, and wherein one end of each receiving structure is pivotably fastened in the pivot hole and the other end thereof is rotatably disposed on the concave portion.

4. The screwdriver kit of claim 1, further comprising a peripheral frame mounted on the base.

5. The screwdriver kit of claim 4, wherein the base further comprises a plurality of engaging slots on an outer surface, and wherein the frame comprises a plurality of wedges on an inner surface, the wedges being inserted into the engaging slots for securing the frame and the base together.

6. The screwdriver kit of claim 1, wherein the spring means first has one end urging against the base and the other end urging against the cover such that the first spring means stores elastic energy when the base is closed by the cover.

7. The screwdriver kit of claim 1, wherein the cover further comprises at least one bottom projection urging against the receiving structures, the projection being disengaged from the receiving structures when the cover is open.

8. The screwdriver kit of claim 1, wherein the slots are adapted to partially receive the plurality of screwdriver heads of different shapes.

9. The screwdriver kit of claim 1, wherein the second spring means is put on the other end of the receiving structure and having an end urging against the base.

10. The screwdriver kit of claim 1, wherein each receiving structure further comprises a U-shaped member at one end, the U-shaped member being engaged with the cover when the base is in the closed position or disengaged therefrom when the base in the open position.

11. The screwdriver kit of claim 10, wherein the U-shaped member is adapted to support a screwdriver handle.

12. The screwdriver kit of claim 1, further comprising a limit block disposed on the pivotal structure, the limit block comprising an intermediate through hole with the body member of the push button being slidably disposed therein.

* * * * *